US009376234B2

(12) United States Patent
Linares

(10) Patent No.: US 9,376,234 B2
(45) Date of Patent: Jun. 28, 2016

(54) PALLET CONSTRUCTION WITH RFID/GPS TRACKING, LIGHT AND SOUND LOCATING FEATURES, IN COMBINATION WITH MAGNETIC STACK-ABILITY

(71) Applicant: Oria Collapsibles, LLC, Auburn Hills, MI (US)

(72) Inventor: Miguel A. Linares, Bloomfield Hills, MI (US)

(73) Assignee: Oria Collapsibles, LLC, Auburn Hills, MI (US)

( * ) Notice: Subject to any disclaimer, the term of this patent is extended or adjusted under 35 U.S.C. 154(b) by 0 days.

(21) Appl. No.: 14/675,101

(22) Filed: Mar. 31, 2015

(65) Prior Publication Data

US 2015/0274359 A1 Oct. 1, 2015

Related U.S. Application Data

(60) Provisional application No. 61/973,559, filed on Apr. 1, 2014.

(51) Int. Cl.
*B65D 19/38* (2006.01)
*B65D 19/00* (2006.01)

(52) U.S. Cl.
CPC ..... *B65D 19/38* (2013.01); *B65D 19/0004* (2013.01); *B65D 19/0028* (2013.01); *B65D 2203/10* (2013.01); *B65D 2203/12* (2013.01); *B65D 2313/04* (2013.01); *B65D 2519/00009* (2013.01); *B65D 2519/00034* (2013.01); *B65D 2519/00069* (2013.01); *B65D 2519/0096* (2013.01); *B65D 2519/00139* (2013.01); *B65D2519/00149* (2013.01); *B65D 2519/00407* (2013.01); *B65D 2519/00736* (2013.01)

(58) Field of Classification Search
CPC ..... B65D 2519/00; B65D 2519/00034; B65D 2519/00119; B65D 2519/00069; B65D 19/38; B65D 19/0004; B65D 19/0028; B65D 2203/10; B65D 2203/12; B65D 2519/00009; B65D 2519/00139; B65D 2519/00149; B65D 2519/00407; B65D 2519/00736; B65D 2519/0096
USPC ..... 108/57.25, 51.11, 53.1, 53.3, 53.5, 108/55.1, 55.3, 55.5, 91, 92
See application file for complete search history.

(56) References Cited

U.S. PATENT DOCUMENTS 3,696,761 A 10/1972 Brown
3,724,398 A * 4/1973 Brennan ..... B65D 19/40 108/55.5

(Continued)

*Primary Examiner* — Jose V Chen
(74) *Attorney, Agent, or Firm* — Dinsmore & Shohl LLP; Douglas J. McEvoy

(57) ABSTRACT

A stackable and nest-able pallet construction including a rectangular shaped insert incorporating structurally supporting and reinforcing members. The insert has a specified thickness encapsulated within a plasticized material and includes a plurality of downwardly extending support feet. Either of edge or corner defined mating locations are established between upper and lower surfaces, such that a second identically configured pallet is capable of being seated in supporting fashion upon a first pallet. To facilitate multiple (non-use) stackability, inter-attracting magnets can be disposed in upper and lower surface proximate locations of each identically configured pallet. The magnets may further include upper surface located and spring loaded magnets in combination with bottom surface recessed magnets of opposite polarity which, upon stacking atop an identically configured pallet, draws the upper spring supported magnet of a lower pallet into seating contact with an opposing and underside situated magnet associated with an upper pallet.

20 Claims, 5 Drawing Sheets

(56) References Cited

U.S. PATENT DOCUMENTS 4,361,822 A 11/1982 Adler
5,195,538 A * 3/1993 Eldridge, Jr. ..... A61B 19/0256 128/849
5,549,056 A * 8/1996 Jordan ..... B65D 19/0018 108/57.25
5,662,048 A * 9/1997 Kralj ..... B65D 19/0012 108/56.1
5,791,262 A * 8/1998 Knight ..... B65D 19/0012 108/57.25
6,209,464 B1 * 4/2001 Elder ..... B65D 19/004 108/53.3
7,825,771 B2 11/2010 Bhogal et al.
8,077,040 B2 * 12/2011 Muirhead ..... B65D 19/0016 340/539.13
8,356,562 B2 1/2013 Palmer
2002/0148393 A1 * 10/2002 Milles ..... B65D 19/0018 108/53.1
2006/0283359 A1 * 12/2006 Johnson ..... B65D 19/00 108/51.11
2008/0053342 A1 * 3/2008 Muirhead ..... B65D 19/0012 108/57.25
2009/0241461 A1 * 10/2009 Linares ..... B65D 19/0038 52/592.1
2011/0061572 A1 3/2011 Liu et al.
2011/0139040 A1 * 6/2011 Apps ..... B65D 19/0018 108/53.3
2014/0060397 A1 * 3/2014 Hernandez ..... B65D 19/0002 108/56.1

* cited by examiner

PALLET CONSTRUCTION WITH RFID/GPS TRACKING, LIGHT AND SOUND LOCATING FEATURES, IN COMBINATION WITH MAGNETIC STACK-ABILITY

CROSS-REFERENCE TO RELATED APPLICATIONS

This Application claims the benefit of U.S. Provisional Application 61/973,559 filed on Apr. 1, 2014, the contents of which are incorporated herein in its entirety.

FIELD OF THE INVENTION

The present invention is directed to a composite stackable pallet construction for providing heavy duty support. More specifically, the present invention discloses a pallet with an insert or structural supporting blank which is sprayed or otherwise coated with a plastic or other polymer based recipe (including such as a proprietary formula and which may also include any particulate or aggregate additive for enhancing desired operational characteristics for varying environmental applications). Without limitation, the proprietary or other plasticized coating can also incorporate, without limitation, a fire/heat proof composite thermoset or composite thermoplastic material.

The three dimensional configured blank or insert can be constructed from any suitable material, not limited to a heavy duty paperboard corrugated material or galvanized insert. The pallet construction can be solid, however can also encompass interiorly extending open aperture locations, these further reducing the overall weight of the pallet without compromising its strength.

As will be further described, the pallet provides a number of useful features, including the incorporation of a GPS/RFID receiver for assisting in tracking of assets or cargo supported upon the pallet. Other features include any type of audio or visual feature, such as blinking lights which are activated by an integrated receiver/transmitter, this activating such as in response to a local transmitter used by warehouse personnel to assist in locating a desired pallet.

Yet additional features include edge or corner located magnets, typically spring loaded, which are positioned at both upper and lower facing surfaces of the pallet and which generate inter-attracting forces with successively stacked pallets, such as in a non-use storage configuration. Other features include downwardly projecting feet which configure pallet fork receiving locations for each pallet and which further mate with pallet upper surface seating recesses to further facilitate ease of stack-ability. Horizontally extending undercut channels formed along exterior corner edge locations of the pallet are also provided to assist in gripping a tautened, pull over edge of an industrial strength stretch wrap for restraining the cargo items supported upon the pallet.

BACKGROUND OF THE INVENTION

The prior art documents various examples of pallet constructions, such as which are capable of being stacked in multiple fashion when not in use. A first example of this is depicted by the pallet construction of Palmer, U.S. Pat. No. 8,356,562, and having a first portion and a second portion that may be arranged in a use or nesting positions to help facilitate more efficient storage of the portions. The portions may also include one or more magnets that may be used to help secure the portions in the use position and/or the nested positions. The portions may include one or more interlocking and/or engaging features that may be used to help secure the portions in the use position and/or the nested positions. If desired, the first and second portions may be sized and configured to be independently used as pallets.

A further example of a magnetic pallet is depicted in U.S. Pat. No. 4,361,822, to Adler, which teaches a plurality of individual, flexible polymer magnetic strips in a double layer thickness between metallic front and back enclosure plates to provide a substantially continuous magnetic field across both of front and back planar surfaces. Other examples drawn from the prior art include the all in one multifunction pallet of Liu et al, US 2011/0061572, which teaches a main part of the pallet, collapsible supporting legs, belts, joint shafts coupled by nuts, and RFID tags.

SUMMARY OF THE INVENTION

The present invention discloses a stackable and nest-able pallet construction including a rectangular shaped insert having a specified thickness and including a plurality of downwardly extending support feet. The insert may also include a plurality of structurally supporting and reinforcing members and which is encapsulated within a plasticized material not limited to at least one of a heat/fire thermosetting and a thermoplastic material. An aggregate material can be entrained within the plasticized material.

Additional features include a plurality of edge or corner defined mating locations established between upper and lower surfaces, such that a second identically configured pallet is capable of being seated in supporting fashion upon a first pallet. The insert may further be constructed of at least one of a galvanized steel, corrugated paperboard, or like rigid and structurally supporting material.

Other features include a receiver incorporated into the insert for providing at least one of tracking and identification of cargo supported upon the pallet. An antenna extending from the receiver can communicate with a remote transmitter.

To facilitate multiple (non-use) stack-ability, inter-attracting magnets can be disposed in upper and lower surface proximate locations of each identically configured pallet. The magnets may further include upper surface located and spring loaded magnets in combination with bottom surface recessed magnets of opposite polarity which, upon stacking atop an identically configured pallet, draws the upper spring supported magnet of a lower pallet into seating contact with an opposing and underside situated magnet associated with an upper pallet.

At least one audio-visual output can be incorporated into the insert for identifying the location of the pallet, upon receipt by said receiver of a location querying signal from the transmitter. The output further may also include a plurality of outer edge and/or corner located LED elements.

Other features include a plurality of stretch wrap gripping locations extending along exterior corner edges of the rectangular shaped insert. The gripping locations may further be configured as horizontally extending undercut channels formed along exterior corner edge locations of the pallet, these assisting in gripping a tautened, pull over edge of an industrial strength stretch wrap for restraining the cargo items supported upon the pallet.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
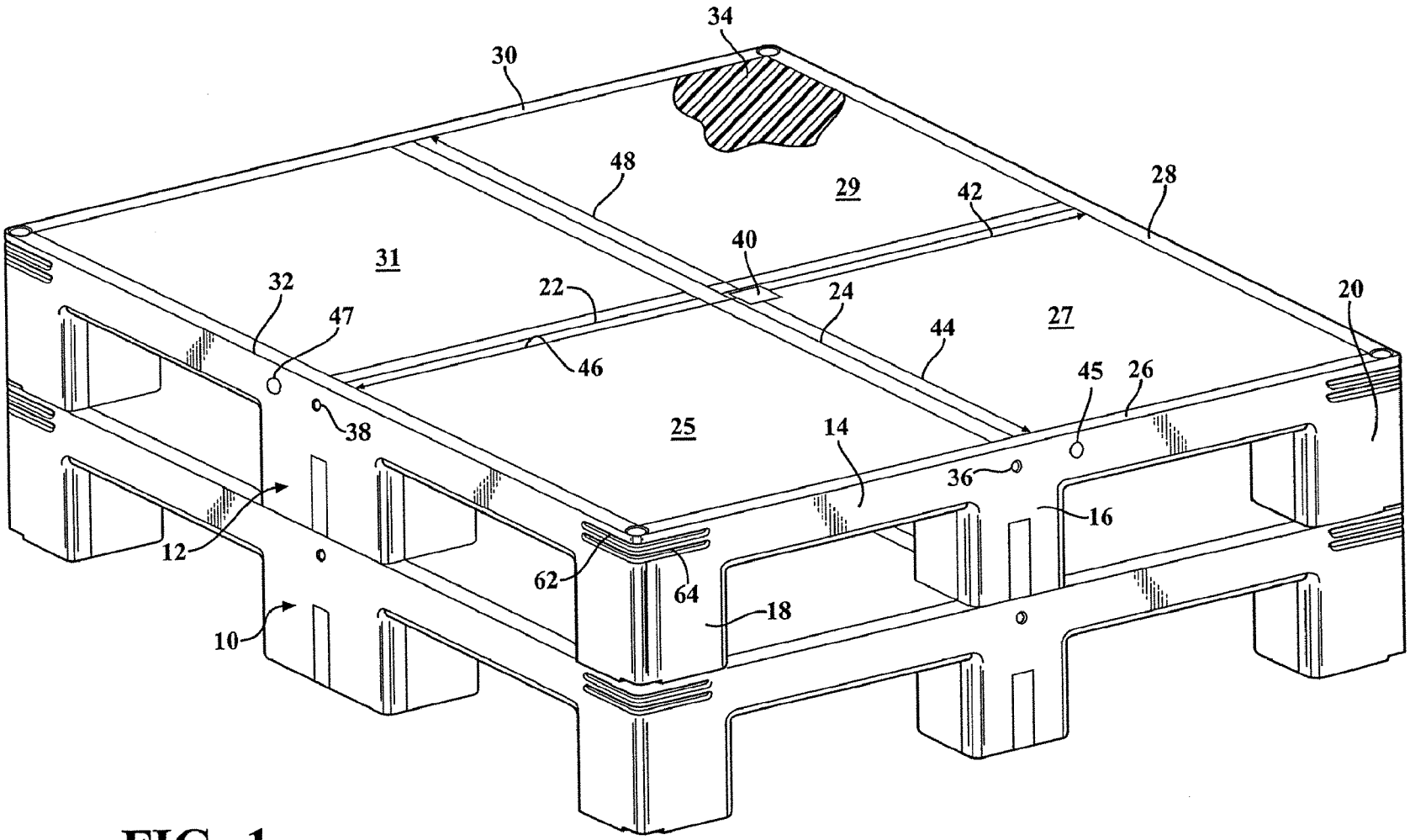
FIG. 1 is a perspective illustration of a pair of magnetically inter-attracting and stacked pallets according to one application of the present invention and also showing an upper stacked pallet with GPS/RFID receiver technology as well as audio/visual identification output.

Referring to FIG. 1, a perspective illustration is provided of a pair of magnetically inter-attracting and stacked pallets, see generally at 10 and 12, according to one application of the present invention. As previously described, the stackable pallet construction is designed so as to provide heavy duty support of items located thereupon and exhibits, according to the selected variant, a structural spine or insert (such as a heavy duty paperboard corrugated material or galvanized insert) which operates to greatly enhance the strength of the pallet assembly in supporting heavier loads set thereupon.

As will also be further described in detail, the manner of constructing the structural pallet article can vary greatly and can, in a most simplified construction, incorporate a sprayable or otherwise coat-able plasticized or polymer material, such including any known or proprietary blend and which can also include any specific additive (such as an aggregate or particulate) which enhances certain operational characteristics best suited for given environmental applications. For purposes of the present description, the composition and techniques surrounding the application of a plastic spray material contemplate such as any type of polystyrene, polyurethane or other material which can be spray applied or flowed over the exposed surfaces of the substratum material in such a way as to maintain it structural integrity while also delivering long term environmental protection.

Without limitation, the term plasticized coating can apply to any type of water-based polymer providing barrier and functional coatings, such as may further incorporate water-based surface modifiers, additives and polymers for numerous industries including wood care, industrial coatings, inks, fibers, composites, and construction products. In other non-limiting applications, the underlying blank or insert can be produced such as by placing within a mold cavity, or other manufacturing medium associated with the creation of the pallet article, and about which is injection molded or otherwise formed a fire/heat proof composite thermoset or composite thermoplastic material.

As will be further described, the completed pallet article can be solid, however can also encompass interiorly extending open apertured locations, recesses or other configurations, these further reducing the overall weight of the pallet without compromising its strength. As will be additionally described with reference to FIGS. 1-5, the underside of each pallet can further exhibit linear width and/or length extending recesses, and which are designed to seat inserting forks associated with a conventional forklift machine.

Referring again to FIG. 1, and as best shown with reference to upper located pallet 12, each insert or blank exhibits a generally three dimensional rectangular shaped body, at 14, from an underside of which projects along each interconnected side a plurality of intermediate side (e.g. at 16) and corner (e.g. at 18 and 20) located and downwardly extending support feet. An additional intermediate/middle support foot is also provided but is hidden from view in FIG. 1. As previously described, the construction of the pallet and support feet is such that intermediate apertures or recesses are defined as shown in relation to the configured underside of the pallet 12 for facilitating insertion of lift forks for elevating and transporting the pallet(s) in individual or multiple stacked fashion.

As further shown, the structural supporting insert can include cross extending or other spinal supporting members 22 and 24, these arranged in a grid shape and which are bounded by edge extending members 26, 28, 30 and 32 in order to achieve a generally rectangular shape. The reinforcing grid components associate with the insert body depict sub-portions of the insert (see likewise rectangular shaped subset portions at 25, 27, 29 and 31 of the molded material associated with upper selected pallet 12). Without limitation, the body 10 can be constructed of a single and heavy duty molded material within which are embedded the structural supporting cross wise grid members 22 and 24. Although not shown, it is also envisioned that the individual portions 25, 27, 29 and 31 can be affixed or seated within recessed locations defined by the insert grid 22/24 and outer perimeter extending sides 26/28/30/32, as well as supported in other ways which maintain the load bearing and structural supporting integrity of the assembly.

A plasticized coating, such as representative of that previously described, is partially depicted in FIG. 1 at 34 applied upon an upper corner portion of selected pallet 14. It is again understood that substantially the entire pallet can be sprayed or otherwise coated with the plastic polymer, such encapsulating all of the pallet components with the exception of the LED (light emitting diode) or other visual identifying features associate with the pallet and as depicted at 36 and 38 with regard to corresponding side edges 26 and 32 which are visible in FIG. 1.

As previously described, each pallet can include a built-in receiver/transmitter, see at 40 for upper pallet 12, and which is communicated, via one or more extending antennas 42, 44, 46 and 48, by a remote (typically location proximate) transmitter, such in one non-limiting variant being a hand-held device employed by warehouse personnel for locating a specific pallet. It is further envisioned and understood that any suitable audio visual structure can be incorporated into the pallet architecture (such as including any piezo type audio emitter shown at 45 and 47 which can be provided along with or in substitution to the LED emitter diodes 36 and 38 and which can operate in combination with a portable processor component embedded or otherwise affixed to such as a recessed pallet underside location), this in order to enhance its article tracking/identification protocols. Such can further include providing illuminating types of components with different color or flashing patterns for identifying certain types of cargo, as well as potentially combining the piezo style emitter for providing an audial output or chirp along with the visual output, one advantage of which being the ability to identify such as an interiorly stacked or like positioned pallet in which the LED or other visual output locations may be partially or entirely obscured.

As further best depicted in FIG. 1 by upper stacked pallet 12, associated global positioning (GPS) or radio frequency identification (RFID) receiver technology can be utilized with the functionality built into the pallet for assisting in tracking and cataloging the cargo identified with the selected pallet(s). Without limitation, such external functionality can incorporate suitable processor and memory features for tracking in real time the location and disposition of various cargo or inventory items associated with a given pallet, such further being associated with JIT (just in time) inventory applications in which a premium is placed on the ability to track and inventory multiple cargo/pallets in remote electronic and real time fashion.

Figure 2:
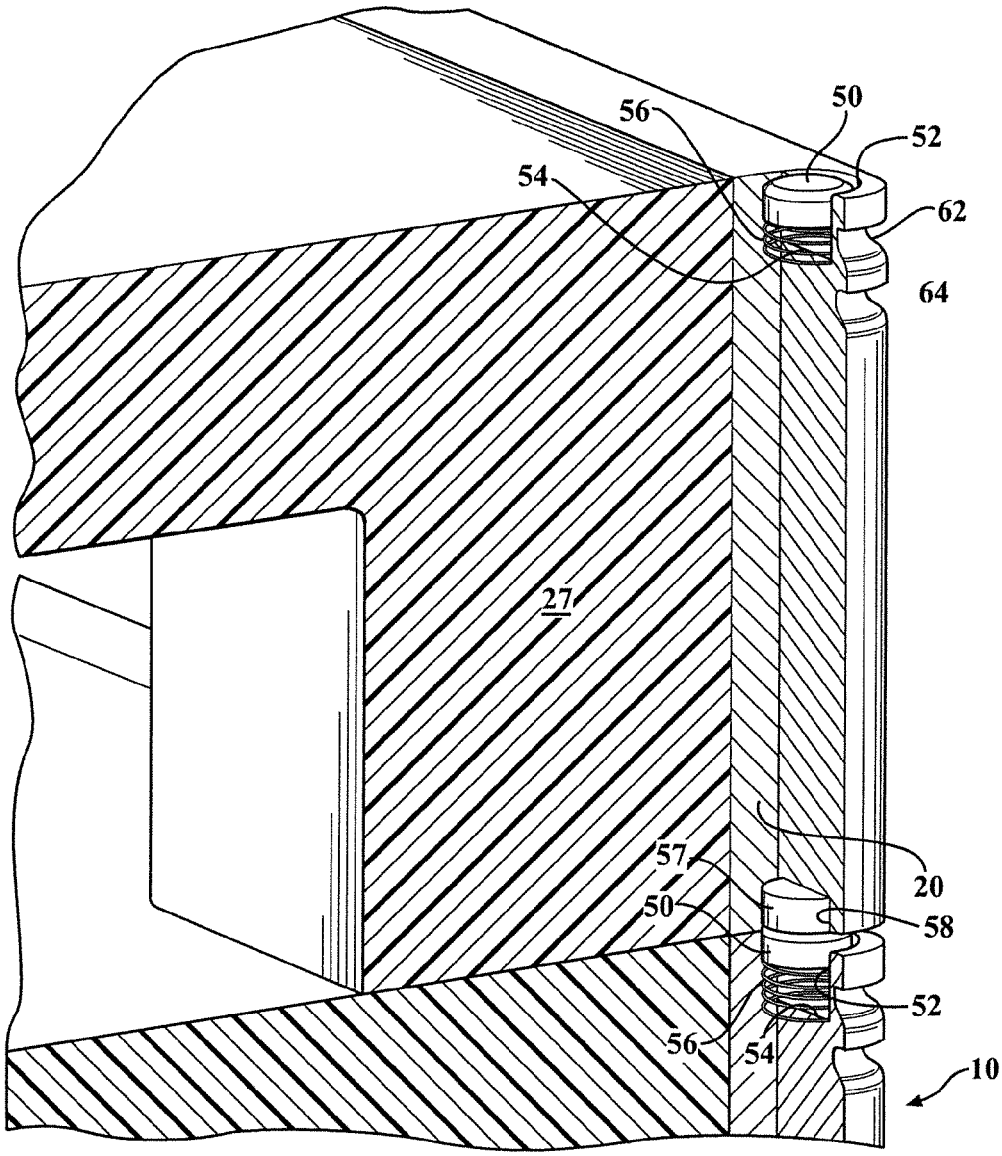
FIG. 2 is an enlarged and partially cutaway corner location of the stacked pallets of FIG. 1 and further showing the configuration of the inter-attracting magnets including an upper surface located and spring loaded magnet, in combination with a bottom surface fixed/recessed magnet of opposite polarity which, upon stacking atop an identically configured pallet, draws the upper spring supported magnet of the lower pallet into a recessed seating location in communication with the underside of the upper pallet.

Proceeding to FIG. 2, an enlarged and partially cutaway corner location is depicted of the stacked pallets 10 and 12 of FIG. 1 and further showing one non-limiting configuration of inter-attracting magnets for providing enhanced stack-ability of multiple pallets, such as during non-use applications not limited to storage or transport. In the example illustration, the selected corner located support foot 20 of the upper pallet 12 includes an upper corner surface located and spring loaded magnet 50, this supported within a pocket or recess 52 defined in the upper corner with a bottom 54, upon which a coil spring 56 secures the magnet 50 in a vertically displaceable manner.

In combination, each pallet 10 and 12 also includes a bottom surface fixed/recessed magnet 57 of opposite polarity with respect to the upper located magnet 50. As further shown, the magnet 57 is seated within an underside corner pocket 58. Upon stacking upon an identically configured pallet 10, the underside magnet 57 operates to upwardly draw the identically configured and upper spring supported and opposite polarity magnet 50 of the lower pallet 10 from a normal position, in which the magnet 50 is held down by the spring so that its upper surface is flush with the top surface of the pallet, to an elevated position in which the magnet 50 is upwardly displaced against the pulling bias of the spring 56 into an adhering engagement with the underside affixed magnet 57 of the upper pallet 12. In this fashion, the pallets are inter-attracted in a fashion which further facilitates and maintains their multiple stack-ability as well as which limits the instances of unexpected lateral or shearing disengagement of the pallets.

Figure 3:
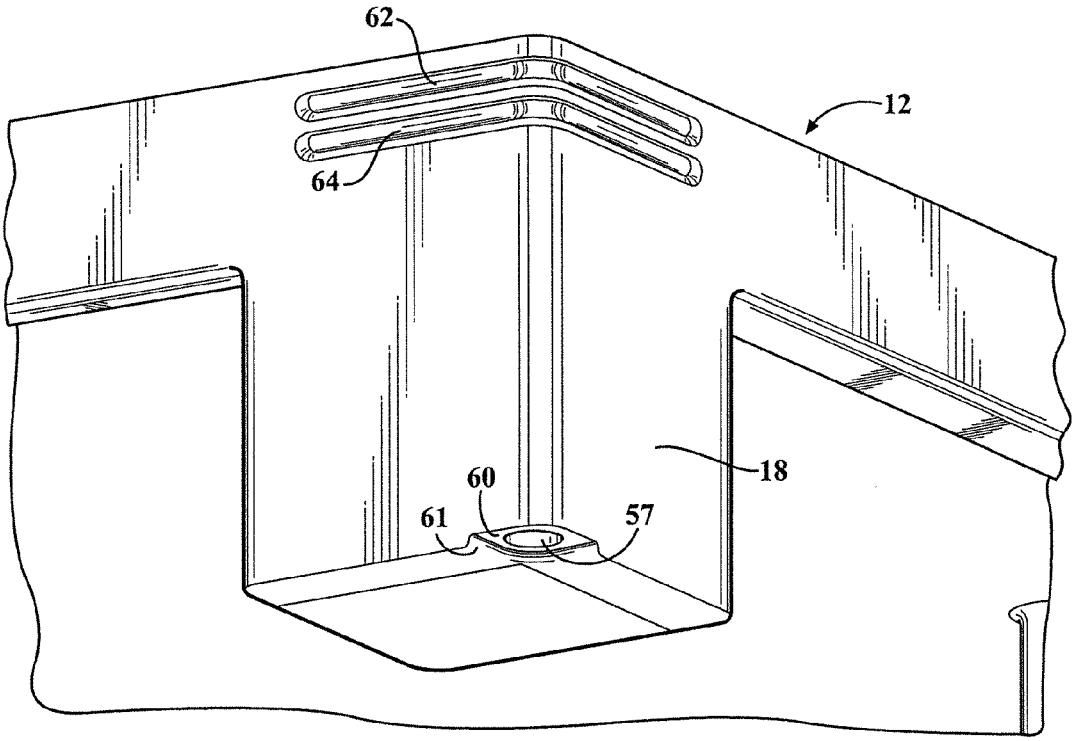
FIG. 3 is a further corner underside perspective of a pallet and depicting a selected support foot with underside seating location for the receiving the spring loaded magnet of FIG. 2, in combination with the exterior corner edge extending channels for gripping pull-over tautened corners of the supporting cargo stretch wrap.

Proceeding to FIG. 3, a further corner underside perspective is shown of pallet 12 and depicting a selected support foot 18 with underside seating location 60 and edge perimeter wall 61, such as for the receiving the spring loaded magnet 50 of FIG. 2 in raised and adhering contact with the underside surface communicating and embedded magnet 57. Also shown are exterior corner edge extending channels 62 and 64, such extending in a generally "L" and cross-sectionally rounded edge shape, the configuration of which is suitable for gripping pull-over tautened corners of an industrial grade cargo restraining and supporting stretch wrap (not shown), upon such being applied over the pallet supported cargo as is typically done in the art. Without limitation, the channels can be reconfigured as protuberances or can provide other surface profiling which is engineered to facilitate a shear gripping condition with the tautened applied edge of the associated wrap material.

Figure 4:
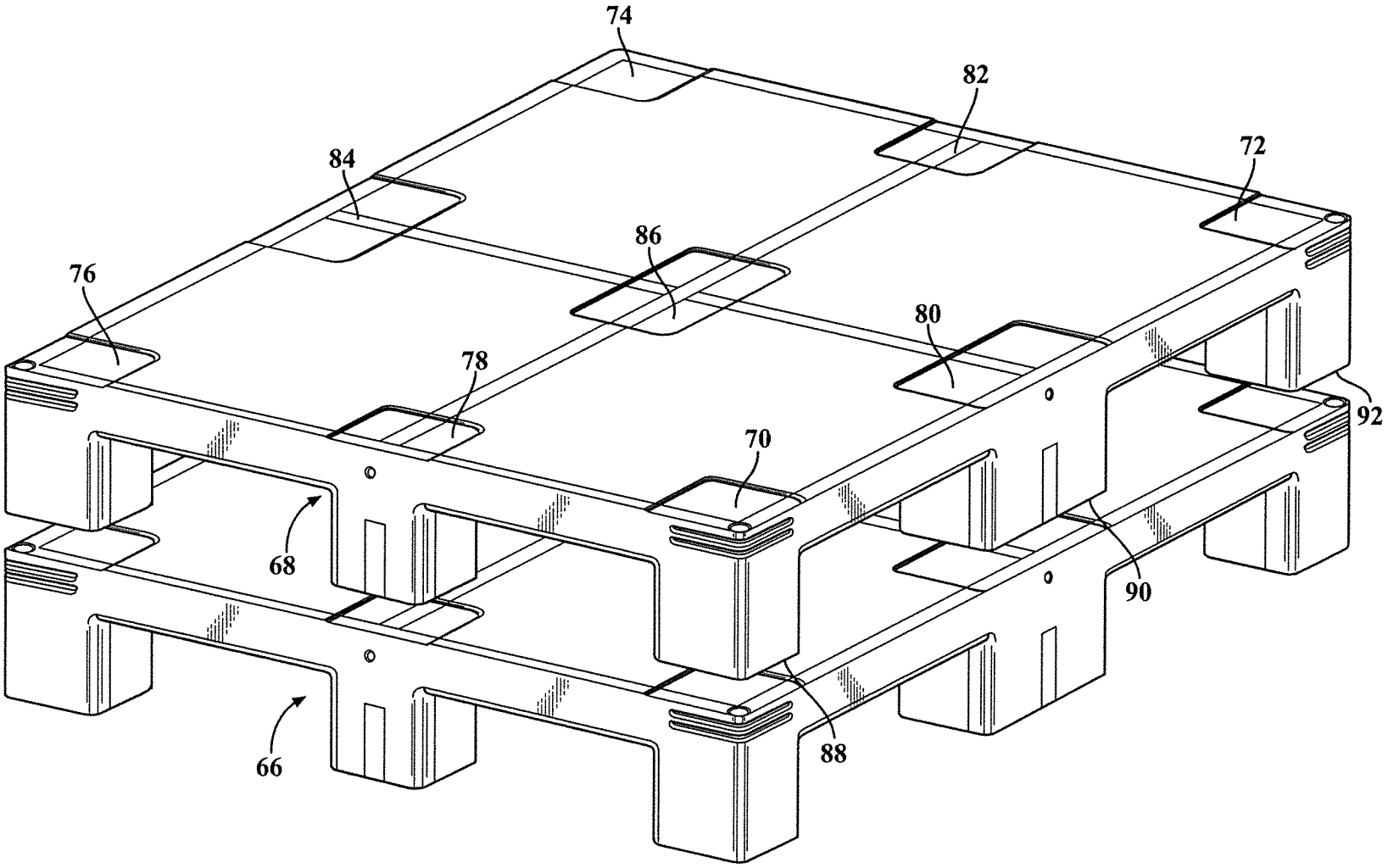
FIG. 4 is an exploded view in perspective of a pair of pallets similar to as illustrated in FIG. 1 and further depicting an alternate construction of a plasticized spray coated pallet blank or insert in combination with upper pallet surface distributed seating recesses arranged in a pattern alignment with opposite bottom footprints associated with the downwardly extending support feet, such acting in combination with the magnetic inter-attraction features for further assisting in preventing lateral or other directed unseating of the magnetically stacked pallets.

Proceeding to FIG. 4, an exploded view is shown in perspective of a pair of pallets, generally at 66 and 66, these being similar to those illustrated in FIG. 1 such that identical or near-identical components will not be repetitively described. As seen, the pallets each further depict an alternate construction of a plasticized spray coated pallet blank or insert.

Also illustrated are upper pallet surface distributed seating recesses, each of these including a perimeter extending edge defining a recessed interior and which are referenced by corner surface recesses 70, 72, 74 and 76, in combination with alternating and intermediate side extending surface recesses 78, 80, 82 and 84. An intermediate or middle recess is further shown and 86 and, upon stacking one pallet (12) upon another pallet (10), are arranged in a pattern alignment with opposite bottom footprints associated with the downwardly extending support feet (see further as represented at 88, 90 and 92 for selected pallet 12), such acting in combination with the magnetic inter-attraction features previously described for further assisting in preventing lateral or other directed unseating of the magnetically stacked pallets.

Figure 5:
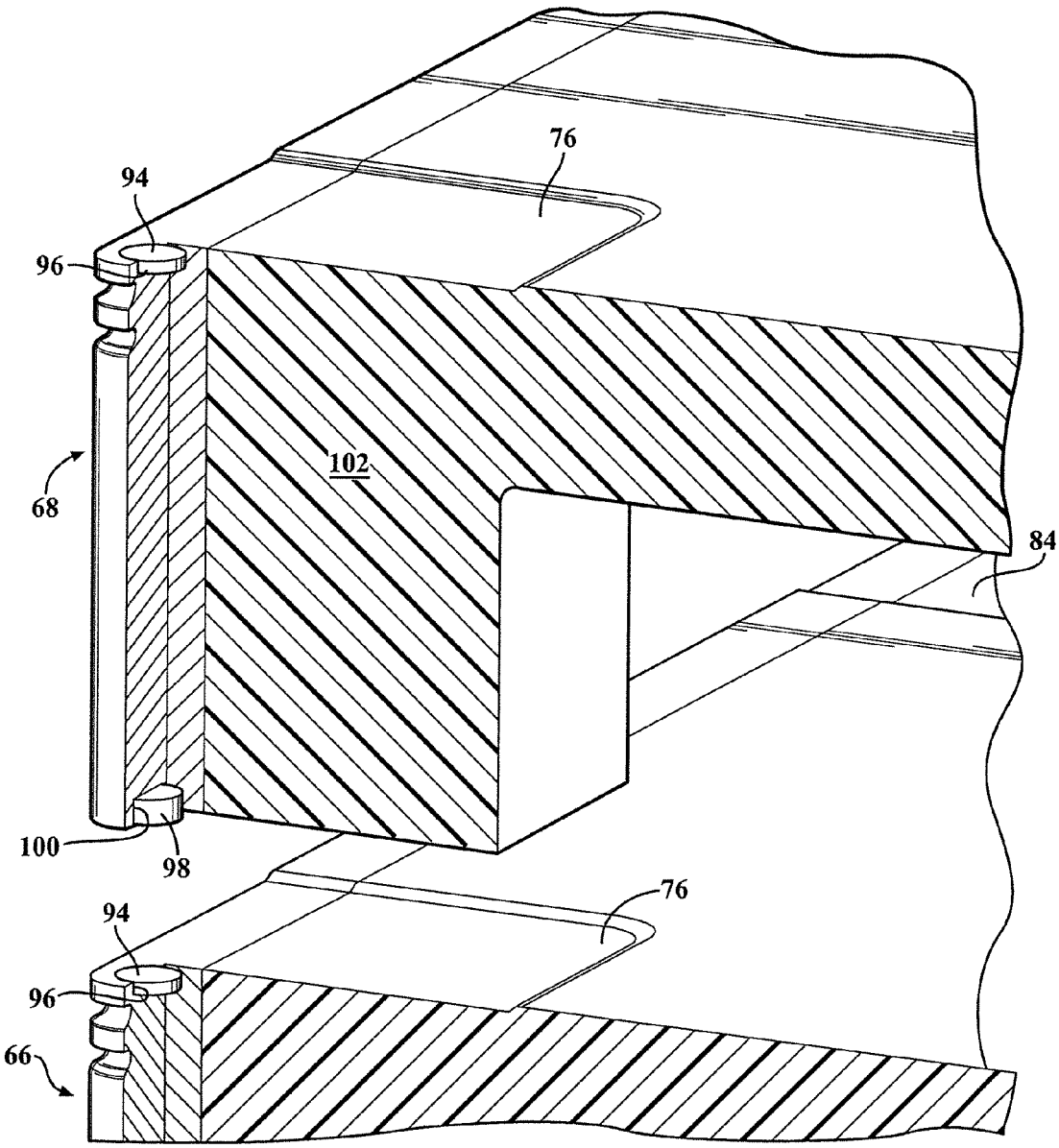
FIG. 5 is an illustration similar to that previously presented in FIG. 2 of an enlarged and partially cutaway corner location of the separated pallets of FIG. 4 and further showing recessed support feet locations associated with the upper surfaces of the pallets as well as a further configuration of inter-attracting magnets including an upper surface aligned magnet in combination with a bottom surface aligned magnet of opposite polarity which, upon stacking atop an identically configured pallet, creates an inter-attracting magnetic bond.

Finally, FIG. 5 is an illustration similar to that previously presented in FIG. 2 of an enlarged and partially cutaway corner location of the separated pallets 66 and 68 of FIG. 4 and further showing selected recessed support feet locations, at 76 and 84, associated with the upper surfaces of the stackable pallets 66 and 68, as well as a further configuration of inter-attracting magnets for assisting in maintaining the pallets in inter-attracting and stacked fashion. In the illustration provided, this variant of the magnets includes an upper surface aligned and corner positioned magnet 94 seated within a corner pocket 96 defined in the selected pallet 68. In combination, a bottom surface aligned magnet 98 of opposite polarity is embedded within an underside aligning pocket 100 and which, upon stacking atop an identically configured pallet, creates an inter-attracting magnetic bond in the manner previously described.

Also envisioned is the possibility of reconfiguring the pallets in order to provide any desired mating and alternating surface configurations for effectively stacking the pallets in multiple fashion. As further shown in the cutaway of FIG. 5, the material construction of the pallets 66/68 can also include a unitary molded body (with or without the grid extending reinforcing members 22/24 depicted in FIG. 1), as well as including other possible shapes and profiles.

Although not shown, additional interior or side edge extending pairs of magnets can be provided in order to modify the attraction forces between the pallets in the stacked configuration. Also, and although not shown, it is also understood that hold down straps and associated strap engagement locations can be integrated into any suitably configured pallet body, these being provided alternate or in combination with the features described herein and in order to better secure items supported thereupon.

Having described my invention, other and additional preferred embodiments will become apparent to those skilled in the art to which it pertains, and without deviating from the scope of the appended claims.

I claim:

1. A pallet, comprising:

a body having a rectangular upper support surface and a plurality of downwardly extending support feet;

magnets disposed in upper and lower surface proximate locations of first and second stacked bodies for facilitating inter-attraction between said bodies in a non-use position; and a first sub-plurality of said magnets, each displace-ably supported upon a spring in turn secured to a selected one of said upper or lower surface proximate locations of each of said bodies, a second and equal sub-plurality of said magnets secured to the other selected one of said upper or lower surface locations of each of said bodies such that, upon stacking a second pallet upon a first identically configured pallet, said first and second sub-pluralities of magnets are in opposing alignment with attracting forces exerted between said magnets causing said first sub-plurality of magnets to displace into seating contact with said second sub-plurality of magnets.

2. The pallet described in claim 1, said body further comprising a molded body which integrates a plurality of structurally supporting and reinforcing members, including first and second interior grid extending members.

3. The pallet as described in claim 1, said body further comprising a plurality of edge or corner defined mating locations established between said upper and bottom surfaces of said first and second stacked pallets, such that said second pallet is capable of being seated in supporting fashion upon said first pallet.

4. The pallet as described in claim 1, said body exhibiting a specified shape and size and further comprising at least one of a galvanized steel, corrugated paperboard, or like rigid and structurally supporting material.

5. The pallet as described in claim 1, further comprising a plasticized material applied to an exterior of said body.

6. The pallet as described in claim 5, said plasticized material further comprising at least one of a heat/fire thermosetting and a thermoplastic material.

7. The pallet as described in claim 5, further comprising an aggregate material entrained within said plasticized material.

8. The pallet as described in claim 1, further comprising a receiver incorporated into said insert for providing at least one of tracking and identification of cargo supported upon said pallet.

9. The pallet as described in claim 8, further comprising at least one antenna extending from said receiver and communicating with a remote transmitter.

10. The pallet as described in claim 9, further comprising at least one audio-visual output incorporated into said insert for identifying the location of said pallet upon receipt by said receiver of a location querying signal from said transmitter.

11. The pallet as described in claim 10, said output further comprising a plurality of edge located LED elements.

12. The pallet as described in claim 1, further comprising a plurality of recessed and extending edge configured gripping locations extending along at least exterior corner edges of said rectangular shaped insert and which are adapted to received stretched over locations associated with a stretch wrap material.

13. A pallet, comprising:

a body having a rectangular upper support surface and a plurality of downwardly extending support feet;

a plurality of edge or corner defined mating locations established between upper and lower surfaces of each of first and second identically constructed pallet bodies arranged in a stacked arrangement, such that the second identically configured pallet is capable of being seated in supporting fashion upon the first pallet; and a first sub-plurality of said magnets, each displace-ably supported upon a spring in turn secured to a selected one of said upper or lower surface proximate locations of each of said bodies, a second and equal sub-plurality of said magnets secured to the other selected one of said upper or lower surface locations of each of said bodies such that, upon stacking a second pallet upon a first identically configured pallet, said first and second sub-pluralities of magnets are in opposing alignment with attracting forces exerted between said magnets causing said first sub plurality of magnets to displace into seating contact with said second sub-plurality of magnets.

14. The pallet as described in claim 13, further comprising a plasticized material applied to an exterior of said body.

15. The pallet as described in claim 13, further comprising a receiver incorporated into said insert for providing at least one of tracking and identification of cargo supported upon said pallet.

16. The pallet as described in claim 15, further comprising at least one antenna extending from said receiver and communicating with a remote transmitter.

17. A pallet, comprising:

a molded body which integrates a plurality of structurally supporting and reinforcing members, including first and second interior grid extending members, said body having a rectangular upper support surface and a plurality of downwardly extending support feet;

first and second sub-pluralities of magnets of opposite polarity distributed across each of upper and lower surfaces of each of first and second identically configured and stacked bodies for facilitating inter-attraction between said bodies in a non-use position; and a selected one of said sub-pluralities of magnets of said first body being displaceable relative to said first body into seating contact with said other selected sub-plurality of magnets of said second stacked body which opposes said displaceable magnets of said first body.

18. The pallet as described in claim 17, further comprising a coil spring supporting an underside of each of said selected and displaceable sub-pluralities of magnets, said coil springs engaging said body.

19. The pallet as described in claim 17, further comprising recess pockets formed in at least one of edge and corner locations and along said upper and lower surfaces of each of said bodies for receiving said first and second sub-pluralities of magnets.

20. The pallet as described in claim 17, further comprising a plurality of recessed and extending edge configured gripping locations extending along at least exterior corner edges of said body and which are adapted to received stretched over locations associated with a stretch wrap material.

* * * * *